US009764911B2

(12) United States Patent
Toso et al.

(10) Patent No.: US 9,764,911 B2
(45) Date of Patent: Sep. 19, 2017

(54) SHEET MEMBER SUPPLY DEVICE AND IMAGE FORMING APPARATUS

(71) Applicant: KONICA MINOLTA, INC., Chiyoda-ku, Tokyo (JP)

(72) Inventors: Yoshiyuki Toso, Toyokawa (JP); Shoichi Yoshikawa, Okazaki (JP); Atsuhiko Shimoyama, Tahara (JP); Yasuhiro Suzuki, Toyohashi (JP); Masahiro Yamaguchi, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/176,180

(22) Filed: Jun. 8, 2016

(65) Prior Publication Data

US 2016/0368722 A1 Dec. 22, 2016

(30) Foreign Application Priority Data

Jun. 16, 2015 (JP) ..... 2015-121339

(51) Int. Cl.

| | |
|---|---|
| ***B65H 1/14*** | (2006.01) |
| ***B65H 3/06*** | (2006.01) |
| *B65H 1/18* | (2006.01) |

(52) U.S. Cl.

CPC ..... *B65H 1/14* (2013.01); *B65H 3/0669* (2013.01); *B65H 1/18* (2013.01); *B65H 2403/481* (2013.01); *B65H 2405/1117* (2013.01)

(58) Field of Classification Search

CPC .... B65H 1/14; B65H 1/08; B65H 2405/1117; B65H 2403/481

See application file for complete search history.

(56) References Cited

U.S. PATENT DOCUMENTS 8,276,906 B2 * 10/2012 Yamamoto ..... B65H 3/0607 271/127
8,511,676 B2 * 8/2013 Kitamura ..... B65H 1/14 271/152

(Continued)

FOREIGN PATENT DOCUMENTS

JP 5-058480 A 3/1993
JP H06-227683 A 8/1994

(Continued)

OTHER PUBLICATIONS

Notice of Reasons for Refusal dated Jun. 20, 2017 issued by the Japanese Patent Office in corresponding Japanese Patent Application No. 2015-121339 and English language translation (11 pages).

(Continued)

*Primary Examiner* — Jeremy R Severson
(74) *Attorney, Agent, or Firm* — Buchanan Ingersoll & Rooney PC

(57) ABSTRACT

A sheet member supply device (40) of an image forming apparatus (1) includes a sheet member stacking plate (43) in which sheet members (S) are stacked on the upper surface, a pickup roller (51) which makes contact with, from above, the uppermost layer of the sheet members (S) stacked on the sheet member stacking plate (43), a stacking plate displacement mechanism (44) which displaces the sheet member stacking plate (43) upward, a motive power transmission mechanism (60) which transmits motive power obtained from a drive source (45) to the stacking plate displacement mechanism (44) and a paradox planetary gear mechanism (65) which is provided in the motive power transmission mechanism (60). In this way, with a simple configuration, it is possible to reduce the unintentional downward displacement of the stacking plate.

11 Claims, 15 Drawing Sheets

(56) References Cited

U.S. PATENT DOCUMENTS

| | | | | |
|---|---|---|---|---|
| 8,800,986 | B2 | 8/2014 | Tomatsu | |
| 8,845,472 | B2 * | 9/2014 | Matsuda | G03G 15/757 475/149 |
| 2012/0187620 | A1 | 7/2012 | Kitamura | |

FOREIGN PATENT DOCUMENTS

| | | | |
|---|---|---|---|
| JP | 2000-274495 | A | 10/2000 |
| JP | 2005-094864 | A | 4/2005 |
| JP | 2007-177405 | A | 7/2007 |
| JP | 2007-269462 | A | 10/2007 |
| JP | 2010-105768 | A | 5/2010 |
| JP | 2010-216535 | A | 9/2010 |
| JP | 2011-043224 | A | 3/2011 |
| JP | 2013-173601 | A | 9/2013 |
| JP | 5371537 | B2 | 12/2013 |

OTHER PUBLICATIONS

First Office Action with English translation, dated Jun. 21, 2017, issued in Chinese Patent Application No. 201610425626.6, 16 pages.

* cited by examiner

SHEET MEMBER SUPPLY DEVICE AND IMAGE FORMING APPARATUS

This application is based on Japanese Patent Application No. 2015-121339 filed on Jun. 16, 2015, the contents of which are hereby incorporated by reference.

BACKGROUND OF THE INVENTION

Field of the Invention

The present invention relates to a sheet member supply device and an image forming apparatus, such as a copying machine, that includes the sheet member supply device.

Description of the Related Art

In an image forming apparatus such as a copying machine, a printer or a facsimile, a supply device of a sheet member such as a sheet is provided. In the sheet member supply device, sheet members stacked on a storage portion are often separated and supplied one by one from the uppermost layer. Conventional technologies related to such a sheet member supply device are disclosed in patent documents 1 to 3.

In each of the sheet member supply devices disclosed in Japanese Unexamined Patent Application Publication Nos. 2007-269462, 2010-105768 and 5-58480, the downstream side in a sheet member supply direction of a sheet member stacking plate in which sheet members are stacked on the upper surface is displaced upward, and thus the uppermost layer of the sheet members makes contact with, from below, a pickup roller for feeding out the sheet member. In these sheet member supply devices, a technology for preventing the sheet member stacking plate from being unintentionally ally displaced downward is proposed.

The sheet member supply device in an image forming apparatus disclosed in Japanese Unexamined Patent Application Publication No. 2007-269462 includes a one-way crutch for regulating the unintentional downward displacement of the sheet member stacking plate. In this way, it is possible to apply a force acting upward to the sheet member stacking plate by constantly providing an appropriate force.

The sheet member supply device in an image forming apparatus disclosed in Japanese Unexamined Patent Application Publication No. 2010-105768 includes: a crutch gear which is formed with a planetary gear mechanism for regulating the unintentional downward displacement of the sheet member stacking plate; and a stopper which is engaged therewith. In this way, the lowering of the sheet member stacking plate is regulated.

The sheet member supply device in an image forming apparatus disclosed in Japanese Unexamined Patent Application Publication No. 5-58480 includes; a worm gear for regulating the unintentional downward displacement of the sheet member stacking plate; and a worm wheel engaged therewith. in this way, a brake action between the worm gear and the worm wheel is utilized, and thus it is possible to hold the posture of the sheet member stacking plate.

However, in the conventional technology disclosed in Japanese Unexamined Patent Application Publication No. 2007-269462, in addition to one-way crutches for motive power transmission and deceleration, another one-way crutch needs to be provided, with the result that the number of components is disadvantageously increased.

In the conventional technology disclosed in Japanese Unexamined Patent Application Publication No. 2010-105768, since the stopper and its nail directly receive the load of a stack of sheet members, without consideration given to sufficient strength, they may be disadvantageously damaged. Disadvantageously, even when they are not damaged, it is likely that the stopper and its nail are elastically deformed, and that thus the sheet member stacking plate is displaced downward. Even when the stopper and its nail are designed with consideration given to sufficient strength, the thickness of the nail may be increased in a circumferential direction of the crutch gear, with the result that there is a concern that the accuracy of a stop position is lowered.

Disadvantageously, in the conventional technology disclosed in Japanese Unexamined Patent Application Publication No. 5-58480, since the brake action (self-holding function) is exerted by a friction between the worm gear and the worm wheel, it is likely that variations in friction force are produced by the change of usage environment, aging degradation or the like and that thus the sheet member stacking plate is displaced downward.

The present invention is made in view of the foregoing points, and an object thereof is to provide a sheet member supply device that can reduce the unintentional downward displacement of the sheet member stacking plate and an image forming apparatus.

SUMMARY OF THE INVENTION

In order to solve the foregoing problems, a sheet member supply device according to the present invention includes: a sheet member stacking plate in which sheet members are stacked on an upper surface; a pickup roller which makes contact with, from above, the uppermost layer of the sheet members stacked on the sheet member stacking plate; a stacking plate displacement mechanism which displaces the sheet member stacking plate upward; a. motive power transmission mechanism which transmits motive power obtained from a drive source to the stacking plate displacement mechanism; and a paradox planetary gear mechanism which is provided in the motive power transmission mechanism.

In the sheet member supply device configured as described above, a motive power transmission switching mechanism which turns on and off the transmission of the motive power from the drive source to the paradox planetary gear mechanism is provided.

In the sheet member supply device configured as described above, the stacking plate displacement mechanism includes a rotation shaft for moving the sheet member stacking plate upward, and the shaft line of a rotation shaft of the paradox planetary gear mechanism coincides with the shaft line of the rotation shaft included in the stacking plate displacement mechanism.

The sheet member supply device configured as described above includes a support member which supports the rotation shaft of the paradox planetary gear mechanism, where a fixed internal gear of the paradox planetary gear mechanism is fixed to the support member.

In the sheet member supply device configured as described above, the fixed internal gear of the paradox planetary gear mechanism is formed integrally in the support member.

In the sheet member supply device configured as described above, the motive power transmission switching mechanism includes a planetary gear mechanism.

In the sheet member supply device configured as described above, between the motive power transmission switching mechanism and the paradox planetary gear mechanism, a motive power transmission regulation portion for transmitting the motive power only in one direction is provided.

In the sheet member supply device configured as described above, the motive power transmission switching mechanism includes a sheet member position detection mechanism for turning on the transmission of the motive power when a predetermined number of the sheet members stacked on the sheet member stacking plate are supplied.

In the present invention, an image forming apparatus includes the sheet member supply device configured as described above and the drive source which applies the motive power to the motive power transmission mechanism.

In the sheet member supply device configured as described above, the drive source applies the motive power to the pickup roller.

DESCRIPTION OF PREFERRED EMBODIMENTS

Embodiments of the present invention will be described below with reference to drawings. The present invention is not limited to the details which will be described below.

Figure 1:
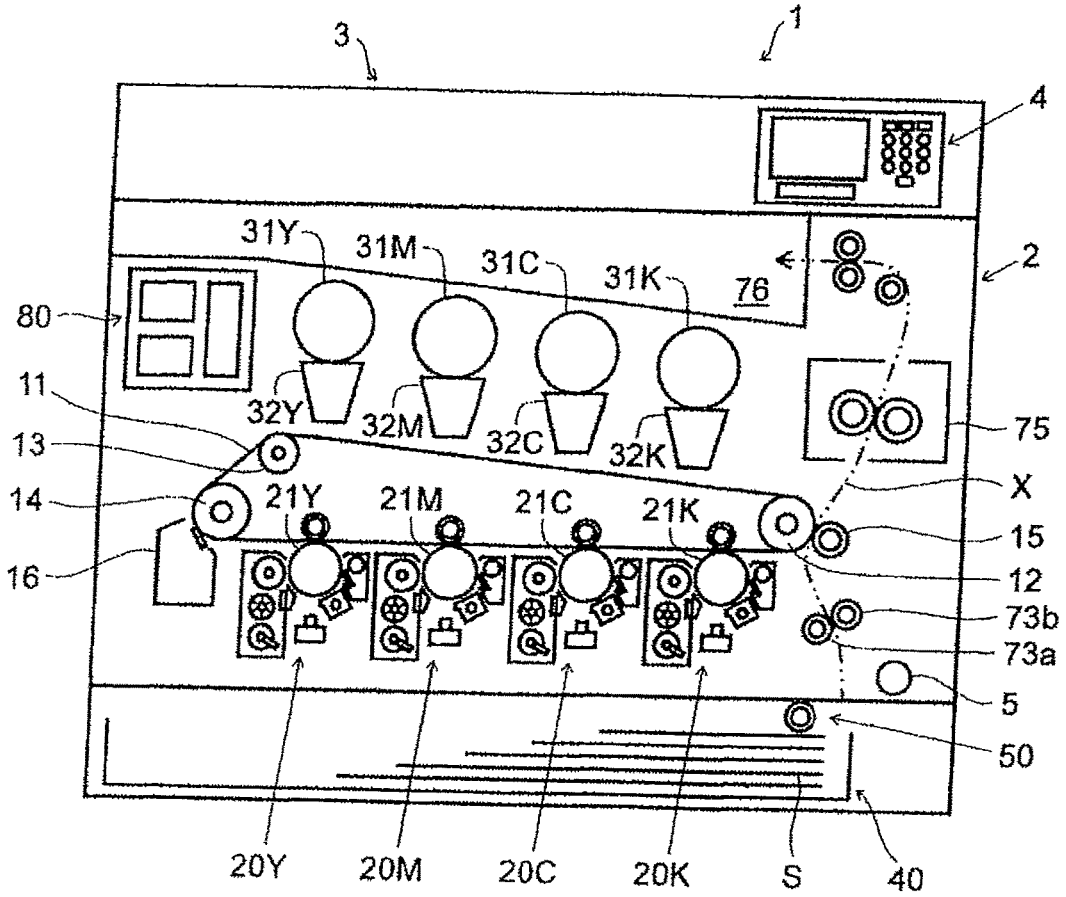
FIG. 1 A schematic partial vertical cross-sectional front view of an image forming apparatus according to a first embodiment of the present invention.

A description will first be given of the outline of the structure of an image forming apparatus according to a first embodiment of the present invention and an image output operation with reference to FIG. 1. FIG. 1 is an example of a schematic partial vertical cross-sectional front view of the image forming apparatus. A two-dot chain line with an arrow in the figure represents the transport path and the transport direction of a sheet.

The image forming apparatus 1 is a so-called tandem-type color copying machine as shown in FIG. 1, and includes an image reader portion 3 that reads the image of an original document, a print portion 2 that prints the read image on a sheet member such as a sheet and an operation display portion 4 for displaying the input of print conditions and an operational status.

The image reader portion 3 is a known image reader that moves a scanner to read the image of the original document placed on platen glass (not shown). The image of the original document is divided into three colors of red (R), green (G) and blue (G), and they are converted with a CCD (Charge Coupled Device) image sensor (not shown) into electrical signals. in this way, the image reader portion 3 obtains image data on each of the colors of red (R), green (G) and blue (G).

On the image data on each of the colors obtained by the image reader portion 3, various types of processing are performed in a control portion 80, the image data is converted into image data on the reproduction colors of yellow (Y), magenta (M), cyan (C) and black (K) and the image data is stored in a memory (not shown) within the control portion 80. The image data on the reproduction colors stored in the memory is subjected to processing for displacement correction and is thereafter read per scanning line in synchronization with the transport of the sheet member so that optical scanning is performed on a photosensitive drum 21 which is an image carrying member.

The print portion 2 forms an image with an electrophotographic system and transfers the image to the sheet member. The print portion 2 includes an intermediate transfer belt 11 obtained by forming an intermediate transfer member as an endless belt. The intermediate transfer belt 11 is wound on a drive roller 12, a tension roller 13 and a driven roller 14. The tension roller 13 receives a force acting upward in FIG. 1 applied by a spring (not shown), and thus a tension is applied to the intermediate transfer belt 11.

The intermediate transfer belt 11 is rotated and moved counterclockwise in FIG. 1 by the drive roller 12. Motive power is transmitted to the drive roller 12 from a drive source 5 such as a motor provided in the main body of the image forming apparatus 1. The drive source 5 may provide the motive power to various types of rollers which will be described later.

The drive roller 12 is pressed onto a secondary transfer roller 15 opposite the drive roller 12 through the intermediate transfer belt 11. In the place of the driven roller 14, an intermediate transfer cleaning portion 16 provided opposite the driven roller 14 through the intermediate transfer belt 11 is brought into contact with the outer circumferential surface of the intermediate transfer belt 11. The intermediate transfer cleaning portion 16 scrapes toner left on the outer circumferential surface of the intermediate transfer belt 11 after secondary transfer, and thereby performs cleaning.

Below the intermediate transfer belt 11, image formation portions 20Y, 20M, 20C and 20K which respectively correspond to the reproduction colors of yellow (Y), magenta (M), cyan (C) and black (K) are provided. In the following description, unless they need to be particularly limited, the identification symbols of "Y", "M", "C" and "K" may be omitted, and for example, they may be collectively referred to as the "image formation portions 20". The four image formation portions 20 are arranged in line along the direction of the rotation of the intermediate transfer belt 11 from the upstream side to the downstream side in the direction of the rotation. The four image formation portions 20 have the same configuration, and the image formation portion 20 includes, therearoudn, a charging portion, an exposure portion, a development portion, a cleaning portion and a primary transfer roller about the photosensitive drum 21 which is rotated clockwise in FIG. 1.

Above the intermediate transfer belt 11, toner bottles 31 and toner hoppers 32 corresponding to the four image formation portions 20 of the reproduction colors are provided. When a decrease in the amount of toner within the development portion is detected by a remaining amount detection portion (not shown), a replenishment device (not shown) is driven so as to replenish the development portion with the toner from the toner hoppers 32 Furthermore, when a decrease in the amount of toner within the toner hoppers 32 is detected by the remaining amount detection portion (not shown), the replenishment device (not shown) is driven so as to replenish the toner hoppers 32 with the toner from the toner bottles 31. The toner bottle 31 is removably provided with respect to the main body of the apparatus, and can be replaced as necessary with a new one.

Below the four image formation portions 20, a sheet member supply device 40 is provided, and sheet members S are stored therewithin. The sheet members S stored within the sheet member supply device 40 are fed out by a supply portion 50 one by one sequentially from the uppermost layer thereof to a sheet member transport path X. The sheet member S fed out from the sheet member supply device 40 to the sheet member transport path X reaches the place of a pair of resist rollers 73*a* and 73*b*. Then, in synchronization with the rotation of the intermediate transfer belt 11, the pair of resist rollers 73*a* and 73*b* feed out the sheet member to a contact portion (secondary transfer nip portion) of the intermediate transfer belt 11 and the secondary transfer roller 15.

In the image formation portion 20, an electrostatic latent image is formed on the surface of the photosensitive drum 21 by the charging portion and the exposure portion, and the electrostatic latent image is visualized by the development portion as a toner image. The toner image formed on the surface of the photosensitive drum 21 is primarily transferred to the outer circumferential surface of the intermediate transfer belt 11 in a place where the photosensitive drum 21 is opposite the primary transfer roller through the intermediate transfer belt 11. Then, as the intermediate transfer belt 11 is rotated, the toner images of the image formation portions 20 are sequentially transferred to the intermediate transfer belt 11 with predetermined timing, and thus a color toner image in which the toner images of the four colors of yellow, magenta, cyan and black are superimposed is formed on the outer circumferential surface of the intermediate transfer belt 11.

The color toner image primarily transferred to the outer circumferential surface of the intermediate transfer belt 11 is transferred to the sheet member S fed by the pair of resist rollers 73*a* and 73*b* in synchronization, in the secondary transfer nip portion formed by bring the intermediate transfer belt 11 and the secondary transfer roller 15 into contact with each other.

Above the secondary transfer nip portion, a fixing portion 75 is provided. The sheet member S to which the unfixed toner image is transferred in the secondary transfer nip portion is fed to the fixing portion 75 and is sandwiched between a heat roller and a pressure roller, and the toner image is fixed to the sheet member S by being heated and melted. The sheet member S passing through the fixing portion 75 is ejected into a sheet member ejection portion 76 provided above the intermediate transfer belt 11.

Figure 2:
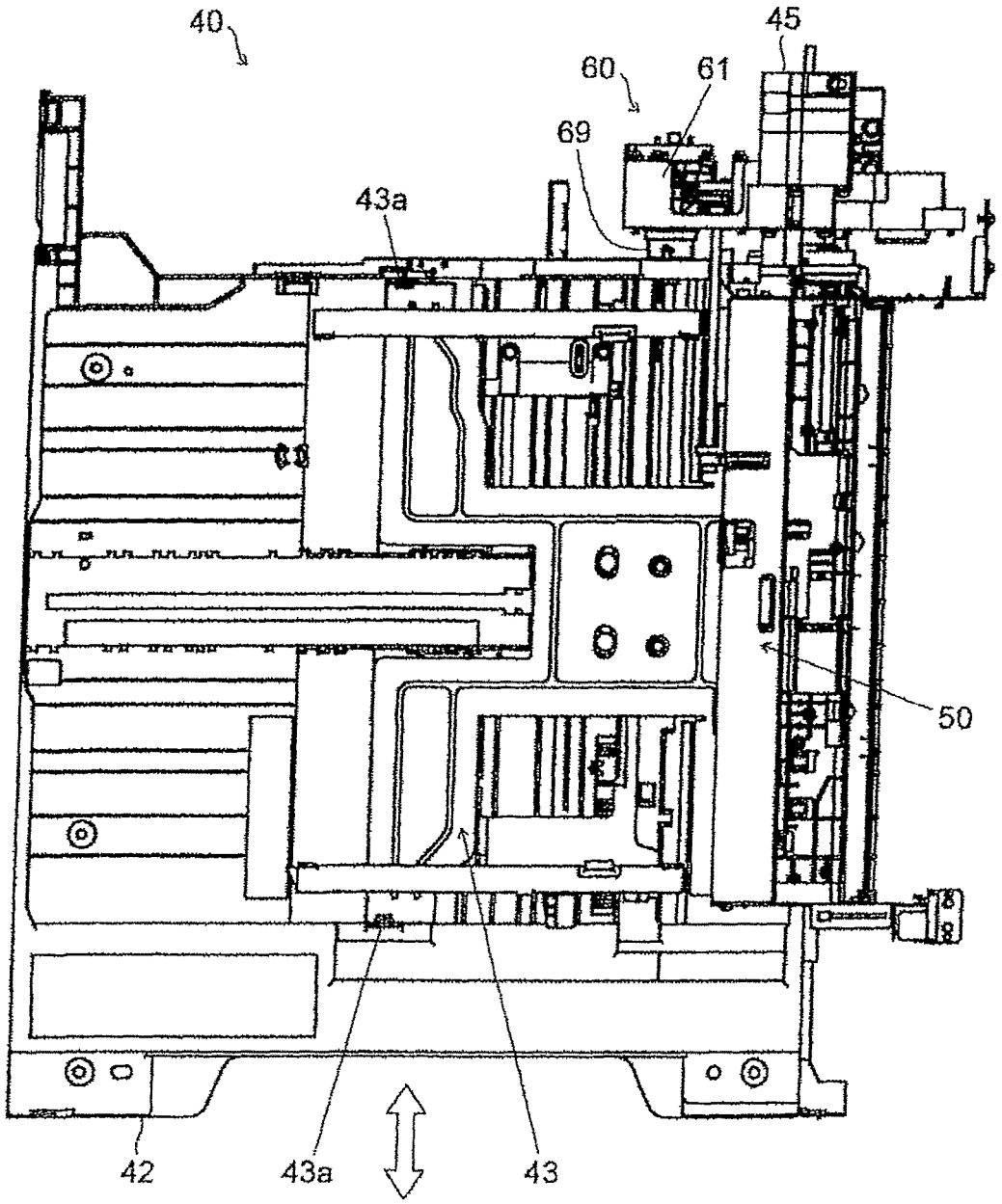
FIG. 2 A plan view of a sheet member supply device according to the first embodiment of the present invention.
Figure 3:
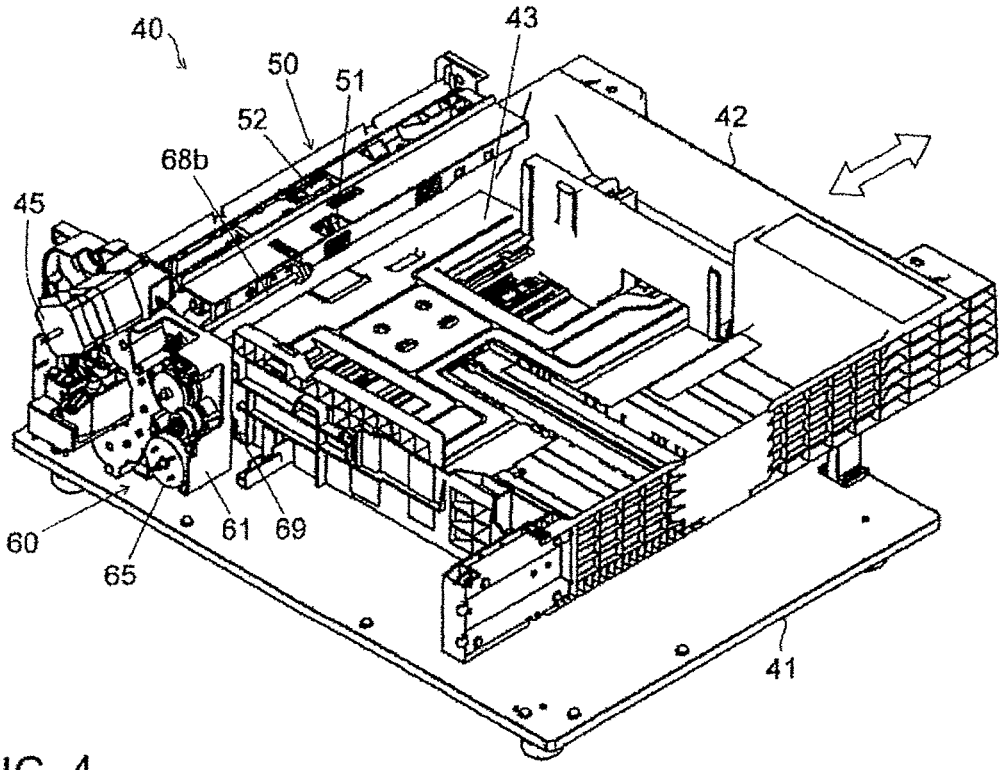
FIG. 3 A perspective view of the sheet member supply device according to the first embodiment of the present invention.
Figure 4:
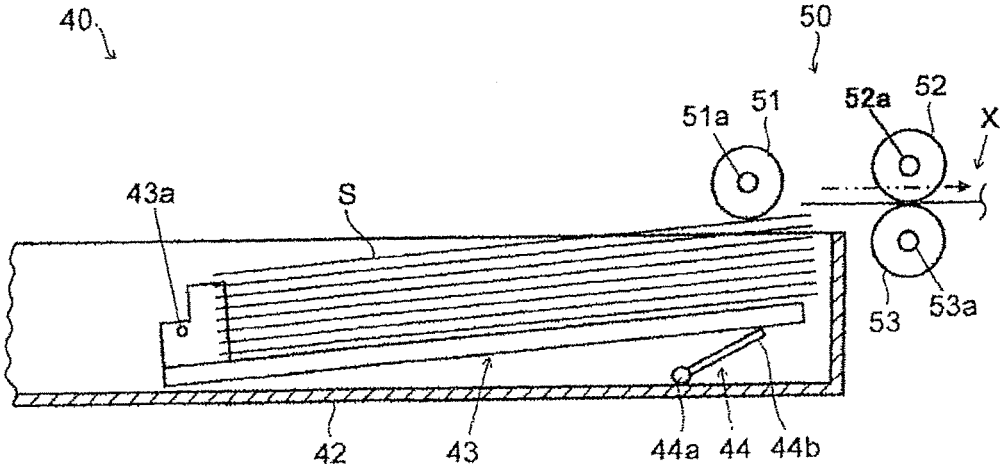
FIG. 4 A vertical cross-sectional partial front view of the sheet member supply device according to the first embodiment of the present invention.
Figure 5:
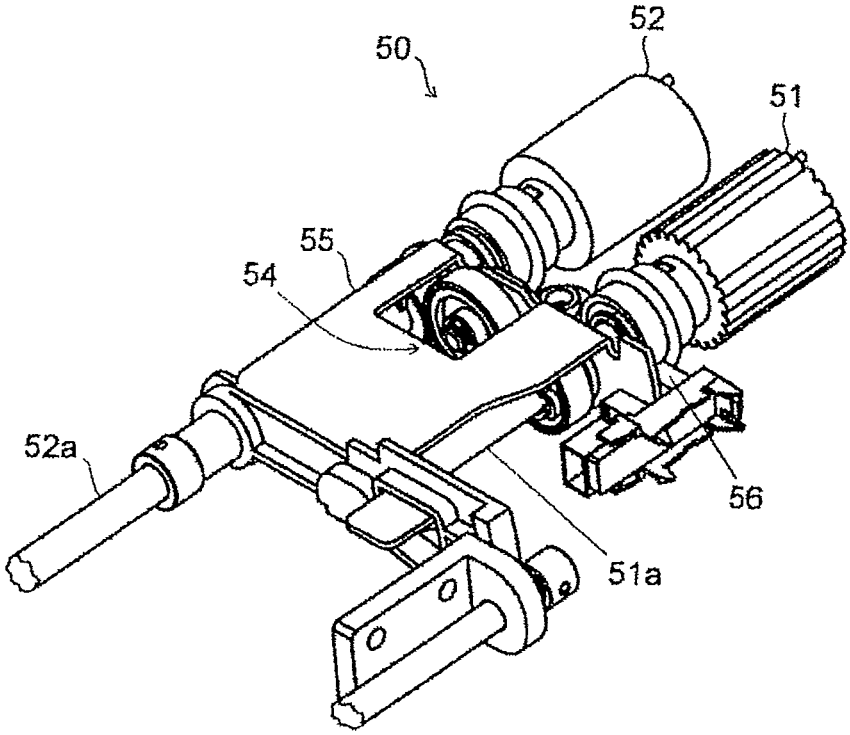
FIG. 5 A perspective view of a supply portion of the sheet member supply device according to the first embodiment of the present invention.

The configuration of the sheet member supply device 40 in the image forming apparatus 1 will then be described with reference to FIGS. 2 to 5. FIGS. 2, 3 and 4 are respectively a plan view, a perspective view and a vertical cross-sectional partial front view of the sheet member supply device 40. FIG. 5 is a perspective view of the supply portion 50 in the sheet member supply device 40. FIGS. 3 and 5 are diagrams when seen from the side of the back surface of the sheet member supply device 40. White-solid arrows in FIGS. 2 and 3 indicate directions (forward and backward directions of the image forming apparatus 1) in which the storage cassette of the sheet member S is drawn and is pushed in. In FIGS. 2 and 4, the illustration of the housing portion of the sheet member supply device 40 is omitted, and in FIGS. 2 and 3, the illustration of the sheet members S is omitted.

As shown in FIGS. 2, 3 and 4, the sheet member supply device 40 includes the housing portion 41 and the storage cassette 42. The storage cassette 42 is a sheet member storage portion in which the sheet members S such as a cut sheet before printing are stacked and stored. The storage cassette 42 is formed in the shape of a flat box whose upper surface is open, and the sheet members S are stacked and stored from the direction of the upper surface. The sheet member S is fed out, by an operation of the supply portion 50 which will be described in detail later, rightward with respect to the storage cassette 42 in FIGS. 2 and 4.

The storage cassette 42 can be made to slide horizontally with respect to the housing portion 41 along a guide portion (not shown) which is provided between the storage cassette 42 and the housing portion 41 so as to be extended in forward and backward directions. The storage cassette 42 can be removed or attached by being drawn or pushed in with respect to the housing portion 41 in the forward and backward directions.

On the inner bottom surface of the storage cassette 42, a sheet member stacking plate 43 is arranged. The sheet members S are placed on the sheet member stacking plate 43 and are stacked. The sheet member stacking plate 43 is supported by the inner bottom surface of the storage cassette 42 at an upstream end in the sheet member supply direction thereof, that is, at a support shaft 43*a* which is provided at a leftward end portion in FIGS. 2 and 4 and which is extended in the forward and backward directions. The sheet member stacking plate 43 can be swung about the support shaft 43*a* within a vertical plane with a downstream end being a free end, and an inclination angle in the sheet member supply direction is varied according to the number of sheet members S stacked on the upper surface. The support shaft 43*a* is provided at two places on the front and back sides of the sheet member stacking plate 43.

Below a downstream portion of the sheet member stacking plate 43 in the sheet member supply direction, a stacking plate displacement mechanism 44 of the sheet member stacking plate 43 is arranged between the sheet member stacking plate 43 and the inner bottom surface of the storage cassette 42 (see FIG. 4). The stacking plate displacement mechanism 44 includes a rotation shaft 44*a* and a push-up lever 44*b*. The rotation shaft 44*a* is extended in the forward and backward directions along the inner bottom surface of the storage cassette 42, and the push-up lever 44*b* is fixed to the end portion on the front side thereof. The push-up lever 44*b* is arranged in a center portion of the sheet member stacking plate 43 in the forward and backward directions, one end in the sheet member supply direction is fixed to the rotation shaft 44*a* and the other end is in contact with the lower surface of the downstream portion of the sheet member stacking plate 43 in the sheet member supply direction. The end portion of the rotation shaft 44*a* on the back side is further protruded backward from the back surface of the storage cassette 42, and a coupling portion 69 which will be described later is provided (see FIG. 2).

When the storage cassette 42 is fitted to the housing portion 41, the end portion of the rotation shaft 44*a* on the back side is coupled through the coupling portion 69 to a motive power transmission mechanism 60 which is provided in the housing portion 41. Then, when the motive power transmission mechanism 60 is operated, the rotation shaft 44*a* and the push-up lever 44*b* are rotated, and the downstream portion of the sheet member stacking plate 43 in the sheet member supply direction is pushed up by the push-up lever 44*b* and is moved upward. When the storage cassette 42 is drawn out from the housing portion 41, and thus the coupling of the rotation shaft 44*a* and the motive power transmission mechanism 60 is cancelled, the sheet member stacking plate 43 falls to the inner bottom surface of the storage cassette 42.

Above the downstream portion of the storage cassette 42 in the sheet member supply direction, the supply portion 50 is arranged in the housing portion 41. The supply portion 50 feeds the sheet member S in the storage cassette 42 to the outside of the storage cassette 42. As shown in FIGS. 4 and 5, the supply portion 50 includes a pickup roller 51, a supply roller 52 and a separation roller 53. The pickup roller 51, the supply roller 52 and the separation roller 53 are provided such that the rotation shafts thereof are extended in a direction intersecting the sheet member supply direction, that is, in the forward and backward directions of the image forming apparatus 1.

The pickup roller 51 is arranged above the downstream portion of the sheet member stacking plate 43 in the sheet member supply direction. The downstream portion of the sheet members S stacked in the storage cassette 42 is raised from below the pickup roller 51 by the sheet member stacking plate 43, and the uppermost layer of the sheet members S is pressed onto and brought into contact with the pickup roller 51 from below. The sheet member S in the storage cassette 42 is passed by the pickup roller 51 to the supply roller 52 and is fed out by the supply roller 52 to the outside of the storage cassette 42.

The supply roller 52 is arranged on the downstream side of the pickup roller 51 in the sheet member supply direction. The supply roller 52 is provided such that a lower portion of the surface thereof is protruded to a sheet member transport path X which is extended from the sheet member supply device 40 to the outside thereof. The supply roller 52 is coupled to a drive source 45 (see FIG. 3) such as a motor which is provided in the housing portion 41 of the sheet member supply device 40 and is rotated.

Between the supply roller 52 and the pickup roller 51, a drive mechanism 54 (which is shown in FIG. 5) of the pickup roller 51 is arranged. The drive mechanism 54 includes a plurality of gears which are coupled to each other, and the supply roller 52 and the pickup roller 51 are coupled through the drive mechanism 54. When the supply roller 52 is rotted by the motor, the pickup roller 51 is also rotated by the drive mechanism 54 in the same direction as the supply roller 52 at the same circumferential velocity.

The supply roller 52 and the pickup roller 51 may obtain motive power not only from the drive source 45 provided in the housing portion 41 of the sheet member supply device 40 but also from the drive source 5 provided in the main body of the image forming apparatus 1.

In the pickup roller 51 and the supply roller 52, the rotation shafts 51*a* and 52*a* thereof are rotatably supported by a coupling member 55. The coupling member 55 is provided in the housing portion 41 such that the coupling member 55 can be swung about the rotation shaft 52*a* within a vertical plane. In this way, the part of the pickup roller 51 in the coupling member 55 can be swung about the rotation shaft 52*a* of the supply roller 52 within the vertical plane. The part of the pickup roller 51 in the coupling member 55 receives a force acting downward exerted by a force application member (not shown) or by the action of gravity.

The separation roller 53 is arranged through the sheet member transport path X below the supply roller 52. The separation roller 53 is pressed onto and brought into contact with the supply roller 52 by the action of the force application member (not shown). The sheet member S is inserted through a nip portion formed by bring the separation roller 53 and the supply roller 52 into contact with each other. The separation roller 53 is not coupled to the motor, and is rotated according to the rotation of the supply roller 52 by being brought into contact with the supply roller 52.

In the separation roller 53, for example, a torque limiter (not shown) is provided at the rotation shaft 53*a* thereof. When no sheet member is present in the nip portion formed by bring the separation roller 53 and the supply roller 52 into contact with each other or when only one sheet member S enters the nip portion, a torque which is equal or more than the set torque of the torque limiter is applied to the separation roller 53, and the separation roller 53 is rotated together with the supply roller 52 in a direction in which the sheet member S is fed out. On the other hand, when a plurality of sheet members S stacked enter the nip portion, the torque applied to the separation roller 53 is less than the set torque of the torque limiter, and the rotation of the separation roller 53 is stopped. In this way, since the sheet members S on the lower side among the sheet members S stacked are prevented from being fed out, it is possible to prevent a problem in which the sheet members S stacked are fed.

The sheet member supply device 40 includes the motive power transmission mechanism 60 at the back of the storage cassette 42 in the housing portion 41 (see FIG. 3). The motive power transmission mechanism 60 transmits the motive power obtained from the drive source 45 to the stacking plate displacement mechanism 44.

Figure 6:
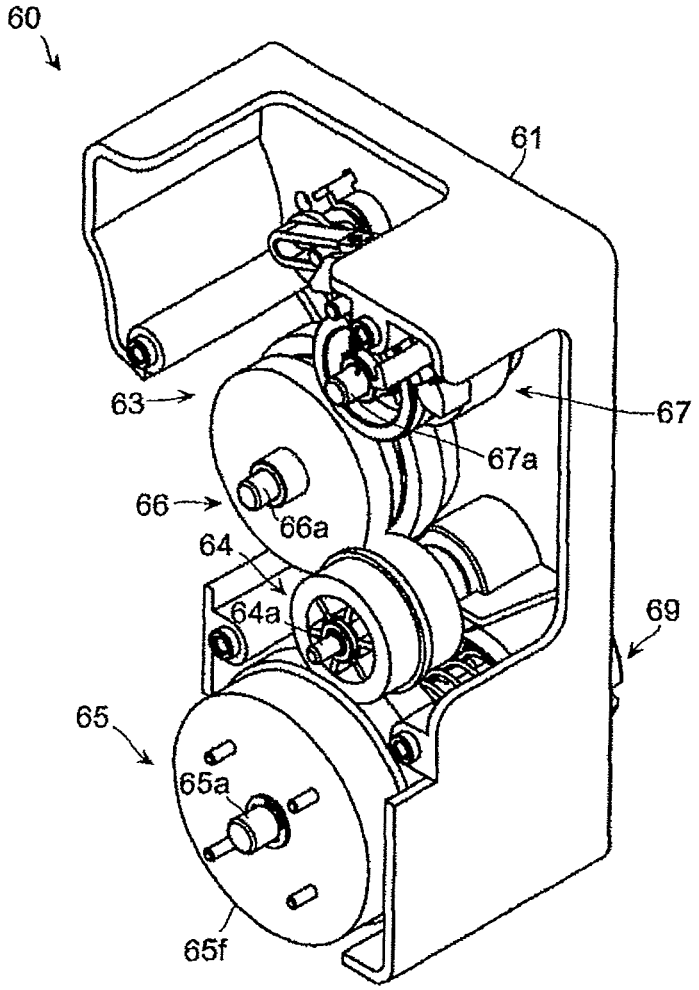
FIG. 6 A perspective view of a motive power transmission mechanism in the sheet member supply device according to the first embodiment of the present invention.
Figure 7:
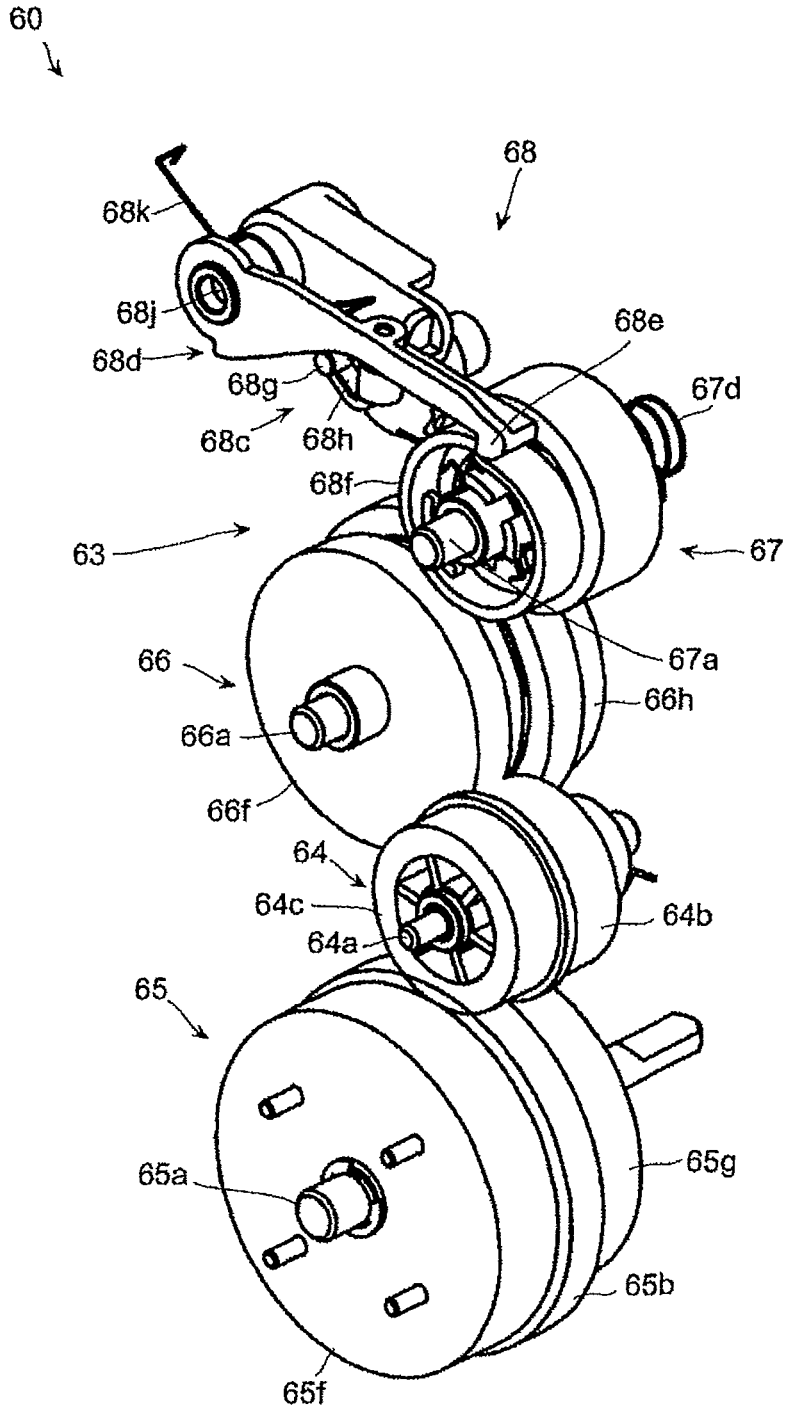
FIG. 7 A perspective view of the motive power transmission mechanism in the sheet member supply device according to the first embodiment of the present invention and showing a state in which a support member is removed.

The configuration of the motive power transmission mechanism 60 in the sheet member supply device 40 will then be described with reference to FIGS. 6 to 12. FIGS. 6 and 7 are respectively a perspective view of the motive power transmission mechanism 60 and a perspective view showing a state in which a support member is removed.

Figure 8:
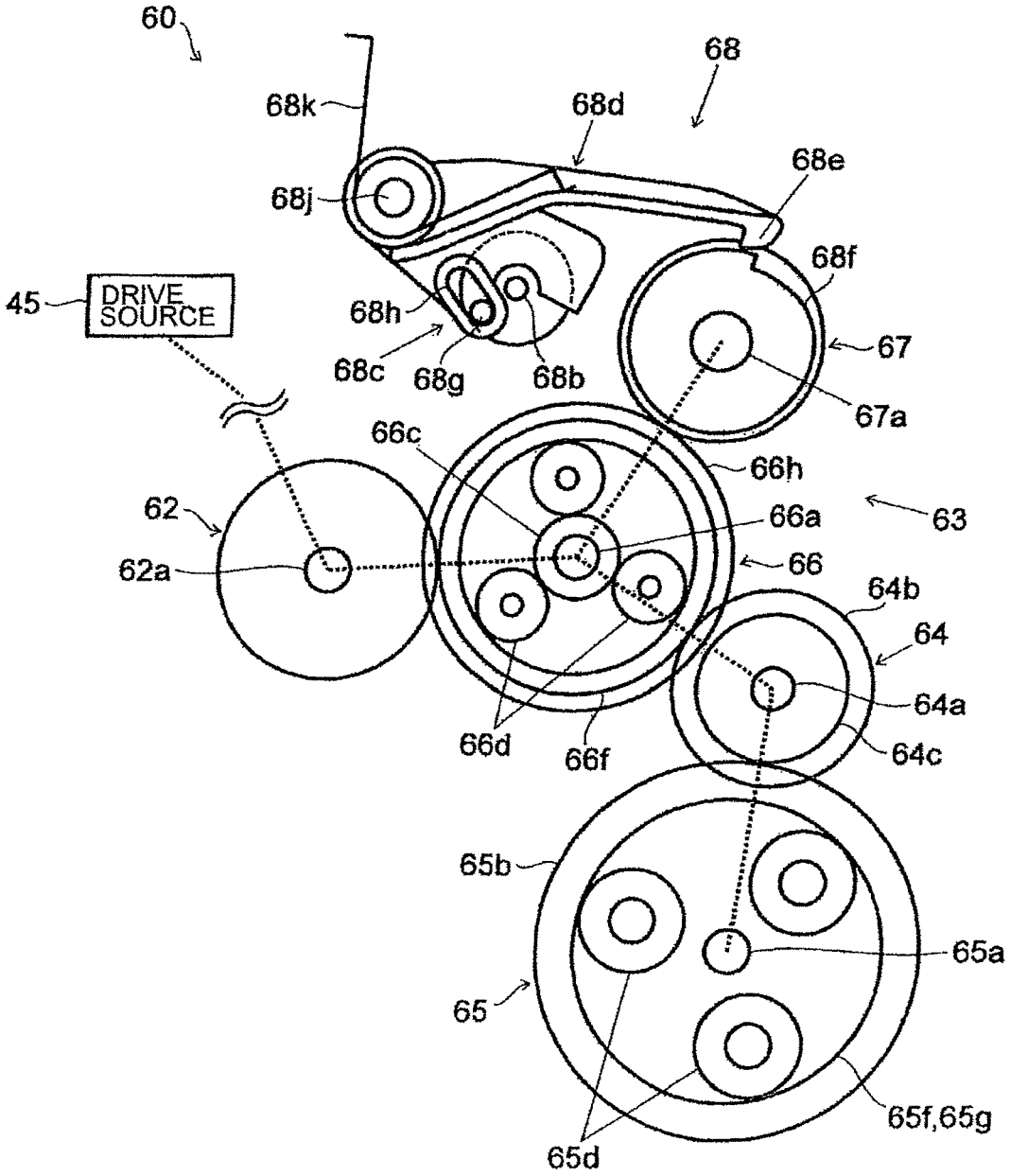
FIG. 8 A schematic back view of the motive power transmission mechanism in the sheet member supply device according to the first embodiment of the present invention.
Figure 9:
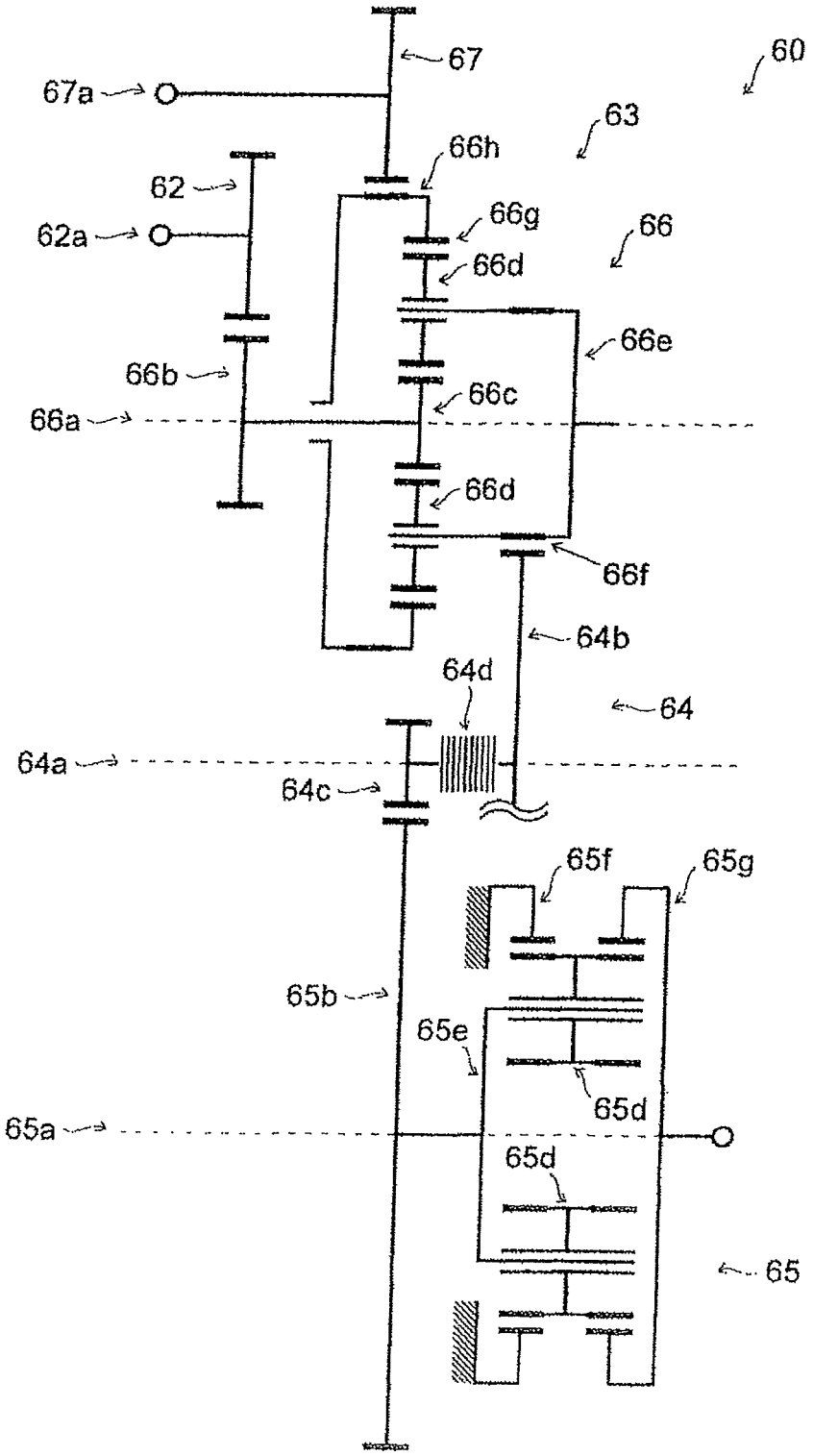
FIG. 9 A skeleton view of the motive power transmission mechanism in the sheet member supply device according to the first embodiment of the present invention.
Figure 10:
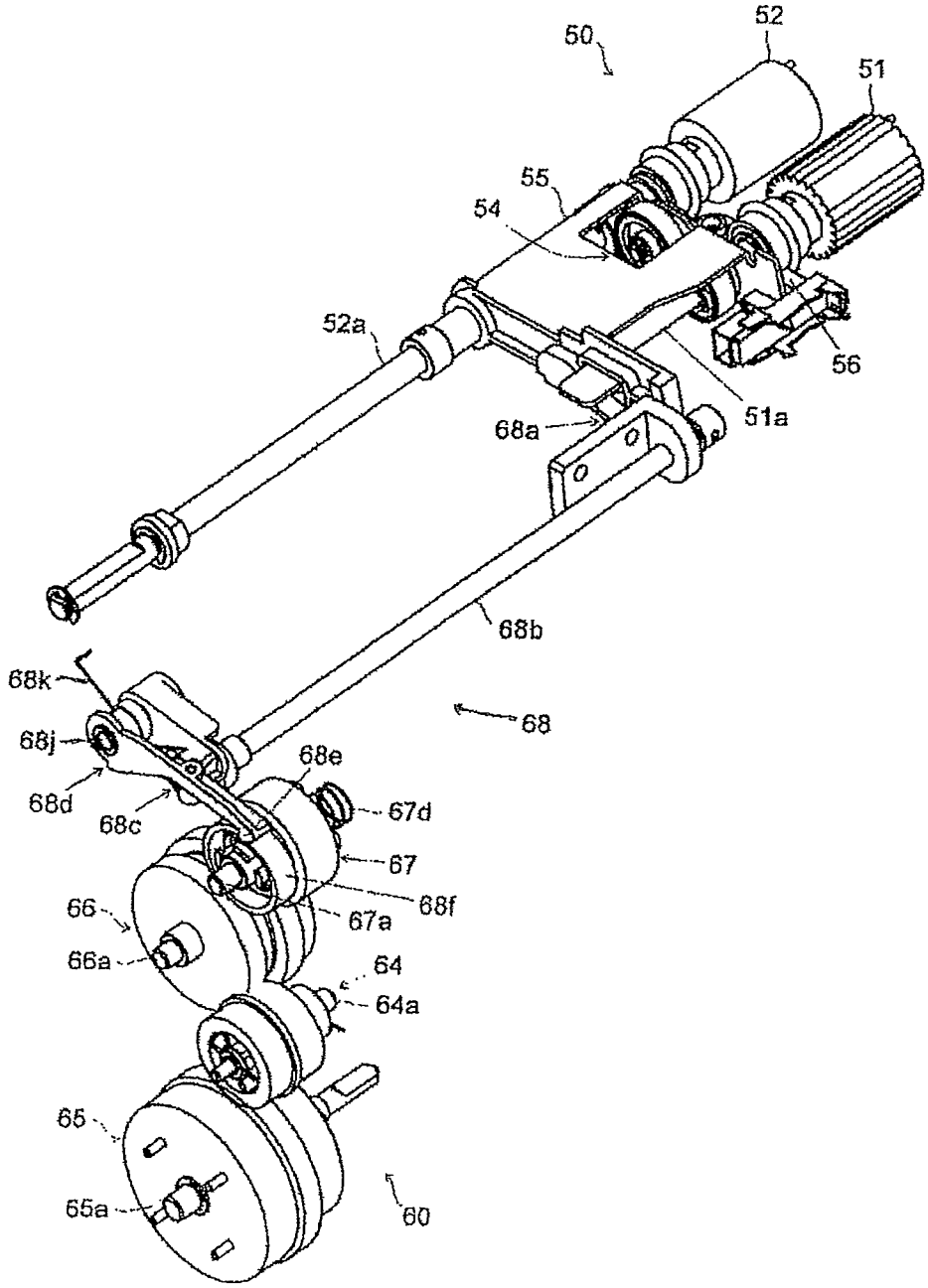
FIG. 10 A perspective view of a motive power transmission switching mechanism in the sheet member supply device according to the first embodiment of the present invention.
Figure 11:
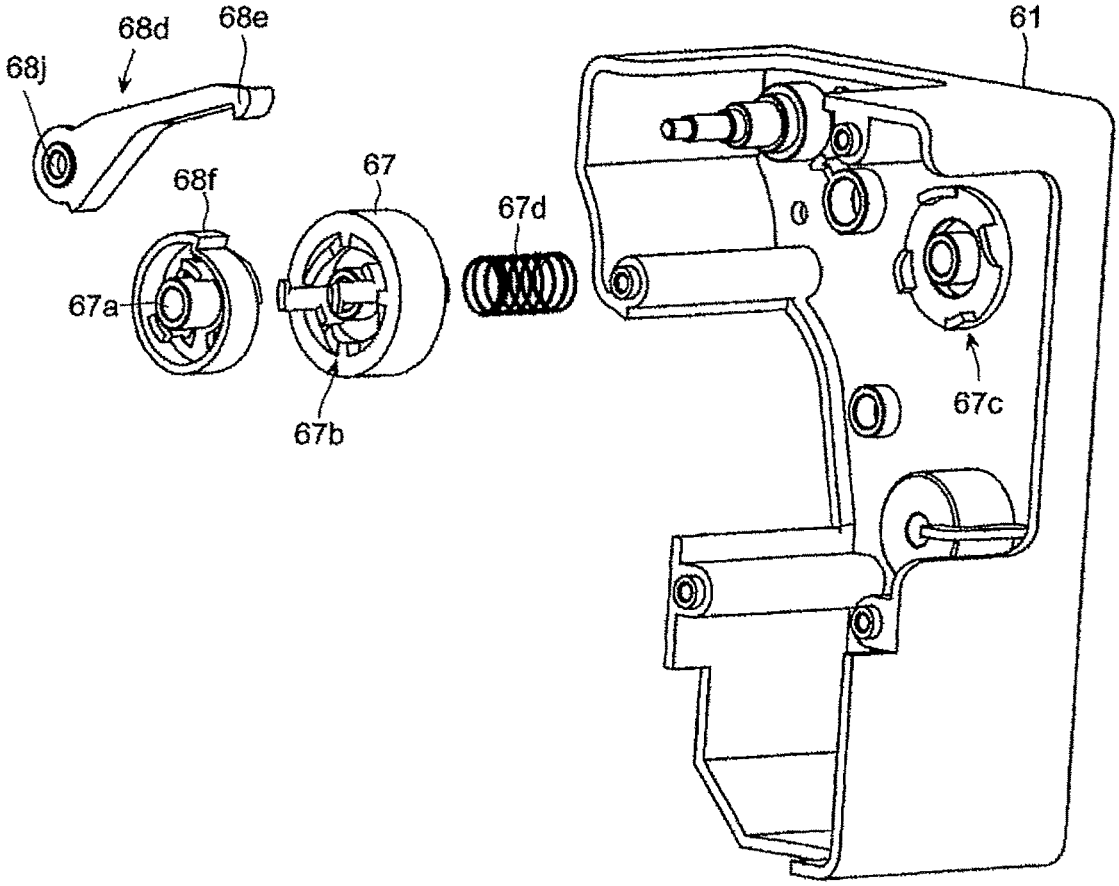
FIG. 11 A perspective view showing the vicinity of a locking gear of the motive power transmission mechanism in the sheet member supply device according to the first embodiment of the present invention.
Figure 12:
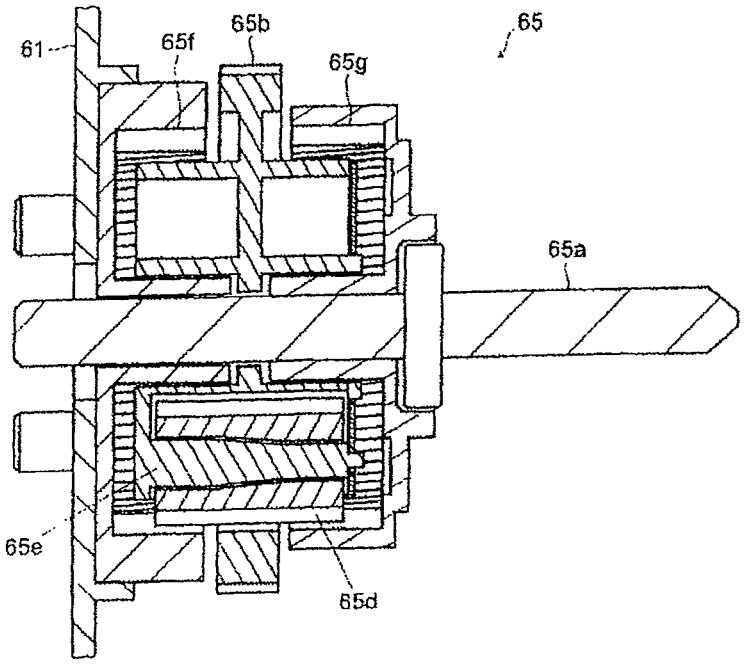
FIG. 12 A horizontal cross-sectional view of a paradox planetary gear mechanism of the motive power transmission mechanism in the sheet member supply device according to the first embodiment of the present invention.

FIGS. 8 and 9 are respectively a schematic back view and a skeleton view of the motive power transmission mechanism 60. FIGS. 10 and 11 are respectively a perspective view of a motive power transmission switching mechanism in the sheet member supply device 40 and a perspective view showing the vicinity of a locking gear in the motive power transmission switching mechanism. FIG. 12 is a horizontal cross-sectional view of a paradox planetary gear mechanism in the motive power transmission mechanism 60. FIG. 11 shows an exploded state of constituent elements along the direction of the shaft line of the locking gear.

As shown in FIG. 6, the motive power transmission mechanism 60 includes the support member 61 which is formed substantially in the shape of a box. In the support member 61, a drive gear 62, the motive power transmission switching mechanism 63, a motive power transmission regulation portion 64 and the paradox planetary gear mechanism 65 shown in FIGS. 6 to 9 are provided, and the rotation shafts of the constituent elements thereof are rotatably supported by the support member 61. As shown in FIG. 8, the motive power obtained from the drive source 45 of the sheet member supply device 40 is sequentially transmitted from the drive gear 62, to the motive power transmission switching mechanism 63 (planetary gear mechanism 66), to the motive power transmission regulation portion 64 and to the paradox planetary gear mechanism 65.

The drive gear 62 is rotatably supported through its rotation shaft 62*a* by the support member 61. The drive gear 62 receives the motive power generated by the drive source 45 either directly or through another unillustrated gear or the like. The drive gear 62 is coupled to the motive power transmission switching mechanism 63 located on the downstream side of the motive power transmission path thereof.

The motive power transmission switching mechanism 63 is coupled to the drive gear 62 to receive the motive power obtained from the drive source 45. The motive power transmission switching mechanism 63 is provided between the drive source 45 and the paradox planetary gear mechanism 65 on the motive power transmission path which is continuous from the drive source 45 to the paradox planetary gear mechanism 65. The motive power transmission switching mechanism 63 includes the planetary gear mechanism 66 and the locking gear 67.

The planetary gear mechanism 66 is rotatably supported through its rotation shaft 66*a* by the support member 61. The planetary gear mechanism 66 includes an input gear 66*b*, a sun gear 66*c*, a planetary gear 66*d*, a planetary carrier 66*e*, an output gear 66*f*, an internal gear 66*g* and a switching gear 66*h*.

The drive gear 62 is coupled to the input gear 66*b*, and the motive power obtained from the drive source 45 is input thereto. The sun gear 66*c* is coaxially connected to the input gear 66*b*. For example, three planetary gears 66*d* are arranged around the sun gear 66*c* about the shaft line of the sun gear 66*c* at equal angular intervals so as to be coupled to the sun gear 66*c*, and revolve around the sun gear 66*c* while rotating. The planetary carrier 66*e* is rotated according to the revolution movement of the planetary gears 66*d*. The output gear 66*f* is provided on the outer circumferential surface of the planetary carrier 66*e*, and is coupled to the input gear 64*b* of the motive power transmission regulation portion 64 which is located on the downstream side of the movement transmission path thereof.

The internal gear 66*g* is an outer ring gear which is coupled to the planetary gears 66*d* on the outer side of the planetary gear 66*d* and which is provided on the inner side of the switching gear 66*h*. The switching gear 66*h* is coupled to the locking gear 67. The locking gear 67 is rotatably supported through its rotation shaft 67*a* by the support member 61 and is connected to the position detection mechanism 68 of the sheet member S.

As shown in FIGS. 8, 10 and 11, the position detection mechanism 68 of the sheet member S includes an engagement portion 68*a*, a lever operation shaft 68*b*, a lever operation cam portion 68*c*, a lever 68*d*, a nail 68*e* and a nail locking cam 68*f*.

As shown in FIG. 10, the engagement portion 68*a* is in a place where the position detection mechanism 68 and the supply portion 50 are close to each other, and is provided on the upstream side in the sheet member supply direction with respect to the supply portion 50. The engagement portion 68*a* is provided in a sector gear (not shown) provided in a coupling member 55 of the supply portion 50 and is provided at one end of the lever operation shaft 68*b* on the front side, and includes a gear (not shown) which is engaged with the sector gear. The sector gear is formed in the shape of a sector which is reciprocated within a given angular range substantially in an up/down direction together with the coupling member 55 which is swung about the rotation shaft 52*a* of the supply roller 52 within a vertical plane. In this way, when the pickup roller 51 is displaced in the up/down direction, the lever operation shaft 68*b* is rotated about its shaft line through the coupling member 55, the sector gear and the gear engaged therewith.

The lever operation shaft 68*b* is extended along the direction intersecting the sheet member supply direction, that is, the forward and backward directions of the image forming apparatus 1, and is rotatably provided in the housing portion 41. At one end of the lever operation shaft 68*b* on the front side, the engagement portion 68*a* is formed, and at one end on the back side, the lever operation cam portion 68*c* is formed.

The lever operation cam portion 68*c* includes a pin 68*g* which is provided in rotation end surface of the lever operation shaft 68*b* and a long hole portion 68*h* which is provided in the lever 68*d*. The pin 68*g* is protruded outward from the rotation end surface of the lever operation shaft 68*b* parallel to the direction of the shaft line of the lever operation shaft 68*b*. The shaft line of the pin 68*g* is arranged in a place which is a predetermined distance apart from the position of the shaft line of the lever operation shaft 68*b* outward in a radial direction. The long hole portion 68*h* is extended along a direction in which the rotation end surface of the lever operation shaft 68*b* is extended, that is, a direction intersecting the direction of the shaft line of the lever operation shaft 68*b*. The pin 68*g* is inserted into the long hole portion 68*h* and is engaged therewith. In this way, as the lever operation shaft 68*b* is rotated, the pin 68*g* is rotated about the lever operation shaft 68*b*, and thus the lever 68*d* is displaced according to the shape of the long hole portion 68*h* with which the pin 68*g* is engaged.

The lever 68*d* is rotatably provided in the housing portion 41 through a rotation shaft 68*j* which is extended along the direction intersecting the sheet member supply direction, that is, the forward and backward directions of the image forming apparatus 1. The lever 68*d* is extended from the place of the rotation shaft 68*j* to the upstream side in the sheet member supply direction, the nail 68*e* is provided at its tip end and the long hole portion 68*h* is provided substantially in an intermediate portion.

The nail 68*e* is engaged with the nail locking cam 68*f*. The lever 68*d* receives a force that is produced by the elasticity of a torsion spring 68*k* provided around the rotation shaft 68*j* and that acts in a direction in which the nail 68*e* is engaged with the nail locking cam 68*f*, that is, in a direction in which in FIGS. 8, 10 and 11, the nail 68*e* is directed downward.

The shaft line of the nail locking cam 68*f* coincides with the shaft line of the rotation shaft 67*a* of the locking gear 67, is adjacent to the rotation end surface of the locking gear 67 and is rotated as the locking gear 67 is rotated. As shown in FIG. 11, between the nail locking cam 68*f* and the locking gear 67, a slide startup portion 67*b* is provided, and between the locking gear 67 and the support member 61, a rotation regulation portion 67*c* is provided. The slide startup portion 67*b* is formed with protrusion portions which are provided in the nail locking cam 68*f* and the locking gear 67 and which are engaged with each other. The rotation regulation portion 67*c* is formed with protrusion portions which are provided in the locking gear 67 and the support member 61 and which are engaged with each other.

The locking gear 67 can be made to slide along the direction of its shaft line between the nail locking cam 68*f* and the support member 61. Between the locking gear 67 and the support a ember 61, a spring 67*d* is provided. The spring 67*d* applies, to the locking gear 67, a force acting in a direction in which the locking gear 67 approaches the nail locking cam 68*f*.

In the configuration of the position detection mechanism 68 described above, when the supply of the sheet members S from the storage cassette 42 proceeds, and thus the position of the pickup roller 51 is lowered, the lever operation shaft 68*b* is rotated counterclockwise in FIG. 8 by the action of the engagement portion 68*a*. In this way, the pin 68*g* of the lever operation cam portion 68*c* is moved downward in FIG. 8 within the long hole portion 68*h*, and thus the lever 68*d* is rotated clockwise in FIG. 8. in other words, the nail 68*e* is moved downward, and is engaged with the nail locking cam 68*f*.

When the nail 68*e* is engaged with the nail locking cam 68*f* to regulate the rotation of the nail locking cam 68*f*, the slide startup portion 67*b* makes the locking gear 67 slide against the elastic force of the spring 67*d* to the support member 61 by the action of the protrusion portions thereof and the action of a rotation force received by the locking gear 67 from the switching gear 66*h*. When the locking gear 67 approaches the support member 61, the nail locking cam 68*f* and the locking gear 67 are engaged with the support member 61 by the action of the protrusion portion of the rotation regulation portion 67*c* such that they cannot be rotated, with the result that the regulation of the rotation of the nail locking cam 68*f* and the locking gear 67 is held.

When the rotation of the locking gear 67 is stopped by the action of the position detection mechanism 68, and the rotation of the switching gear 66*h* is stopped, the internal gear 66*g* functions as a fixed element. In this way, the planetary gear mechanism 66 can decelerate the motive power input to the input gear 66*b*, transmit it to the output gear 66*f* and outputs it from the output gear 66*f* to the motive power transmission regulation portion 64. As described above, the motive power transmission switching mechanism 63 turns on the transmission of the motive power from the drive source 45 to the paradox planetary gear mechanism 65.

On the other hand, when the locking gear 67 and the switching gear 66*h* can be rotated, and the internal gear 66*g* does not function as the fixed element, the output gear 66*f* is not properly rotated due to a load produced by being coupled with the motive power transmission regulation portion 64. In other words, the internal gear 66*g* and the switching gear 66*h* are idled, and thus the motive power input to the input gear 66*b* is not output from the output gear 66*f*. In this way, the motive power transmission switching mechanism 63 turns off the transmission of the motive power from the drive source 45 to the paradox planetary gear mechanism 65.

The motive power transmission regulation portion 64 is coupled to the motive power transmission switching mechanism 63 to receive the motive power obtained from the drive source 45. The motive power transmission regulation portion 64 is provided between the motive power transmission switching mechanism 63 and the paradox planetary gear mechanism 65 on the motive power transmission path which is continuous from the drive source 45 to the paradox planetary gear mechanism 65.

The motive power transmission regulation portion 64 is rotatably supported through its rotation shaft 64*a* by the support member 61. The motive power transmission regulation portion 64 includes the input gear 64*b*, an output gear 64*c* and a regulation member 64*d*.

The output gear 66*f* of the motive power transmission switching mechanism 63 is coupled to the input gear 64*b*, and the motive power obtained from the drive source 45 is input thereto. The input gear 64*b* and the output gear 64*c* are coaxially connected through the regulation member 64*d*. The regulation member 64*d* is arranged between the input gear 64*b* and the output gear 64*c*. The regulation member 64*d* is formed with a function member, such as a kick spring or a one-way clutch, which transmits the motive power only in one direction. When the motive power transmission switching mechanism 63 turns off the transmission of the motive power from the drive source 45 to the paradox planetary gear mechanism 65, the motive power transmission regulation portion 64 prevents the output gear 64*c* from being unintentionally rotated by the action of the regulation member 64d.

The paradox planetary gear mechanism 65 is coupled to the motive power transmission regulation portion 64 to receive the motive power obtained from the drive source 45. The paradox planetary gear mechanism 65 is rotatably supported through tits rotation shaft 65*a* by the support member 61. As shown in FIGS. 8, 9 and 12, the paradox planetary gear mechanism 65 includes an input gear 65*b*, a planetary gear 65*d*, a planetary carrier 65*e*, a fixed internal gear 65*f* and a movable internal gear 65*g*.

The output gear 64*c* of the motive power transmission regulation portion 64 is coupled to the input gear 65*b*, and the motive power obtained from the drive source 45 is input thereto. The planetary carrier 65*e* is coaxially connected to the input gear 65*b*. For example, three planetary gears 65*d* are provided in the outer circumferential portion of the planetary carrier 65*e*. The three planetary gears 65*d* are arranged about the shaft line of the input gear 65*b* at equal angular intervals no as to revolve around the shalt line of the input gear 65*b* while rotating. The planetary gear 65*d* is coupled to the fixed internal gear 65*f* and the movable internal gear 65*g*. The fixed internal gear 65*f* and the movable internal gear 65*g* are arranged such that the shaft lines thereof coincide with the shaft line of the input gear 65*b*. The fixed internal gear 65*f* is fixed to the support member 61 such that the fixed internal gear 65*f* cannot be rotated. The rotation shaft 65*a* is connected to the movable internal gear 65*g*.

The deceleration ratio of the paradox planetary gear mechanism 65 is represented by formula (1) below. For example, when it is assumed that the number of teeth of the movable internal gear is 44 and that the number of teeth of the fixed internal gear is 41, the deceleration ratio of the paradox planetary gear mechanism 65 is 33/44. The paradox planetary gear mechanism 65 has a self-lock function (self-holding function) by the action of the relatively high deceleration ratio. In this way, the paradox planetary gear mechanism 65 is prevented from being reversely rotated by aloud from the side of the rotation shaft 65*a* which is the output side.

deceleration ratio=(number of teeth of movable internal gear−number of teeth of fixed internal gear)/number of teeth of movable internal gear Formula (1):

The shaft line of the rotation shaft 65*a* in the paradox planetary gear mechanism 65 coincides with the shaft line of the rotation shaft 44*a* in the stacking plate displacement mechanism 44. In the places of an end portion of the paradox planetary gear mechanism 65 on the front side of the rotation shaft 65*a* and an end portion of the stacking plate displacement mechanism 44 on the back side of the rotation shaft 44*a*, the coupling portion 69 is provided (see FIGS. 2 and 6). The coupling portion 69 is formed with, for example, a concave portion which is provided at the end portion of the paradox planetary gear mechanism 65 on the front side of the rotation shaft 65*a* and a convex portion which is provided at the end portion of the stacking plate displacement mechanism 44 on the back side of the rotation shaft 44*a* (both of which are not shown). The concave portion and the convex portion of the coupling portion 69 are formed in such a shape that they can be engaged with each other.

When the storage cassette 42 is fitted to the housing portion 41, the rotation shaft 65*a* of the paradox planetary gear mechanism 65 and the rotation shaft 44*a* of the stacking plate displacement mechanism 44 are engaged with and coupled to each other through the coupling portion 69. In this way, it is possible to transmit the motive power obtained from the drive source 45 to the rotation shaft 44*a* of the stacking plate displacement mechanism 44. The engagement of the rotation shaft 65*a* of the paradox planetary gear mechanism 65 and the rotation shaft 44*a* of the stacking plate displacement mechanism 44 by the coupling portion 69 can be easily cancelled by drawing the storage cassette 42 out from the housing portion 41.

Figure 13:
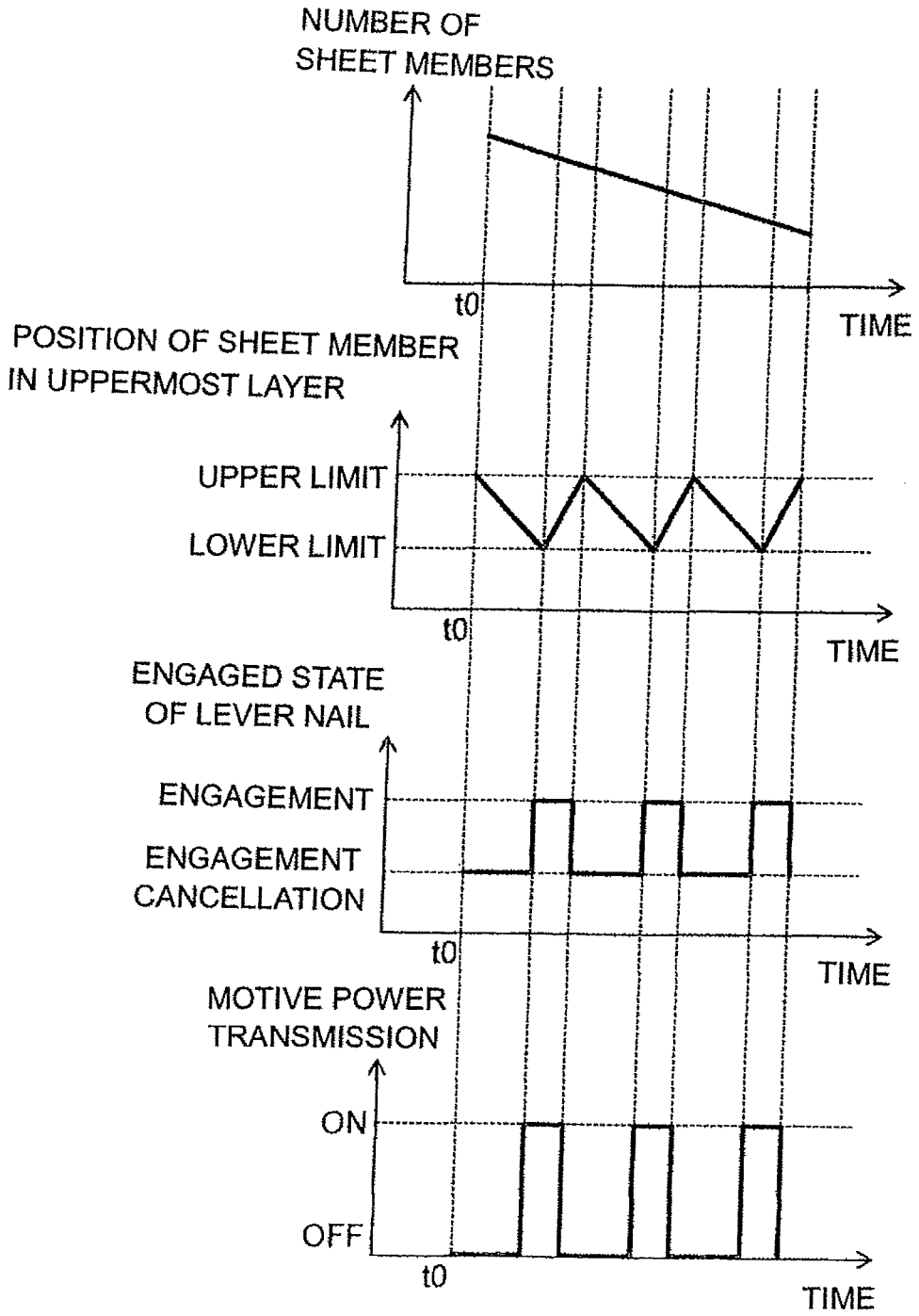
FIG. 13 A timing chart showing an operation of the motive power transmission mechanism in the sheet member supply device according to the first embodiment of the present invention.
Figure 14:
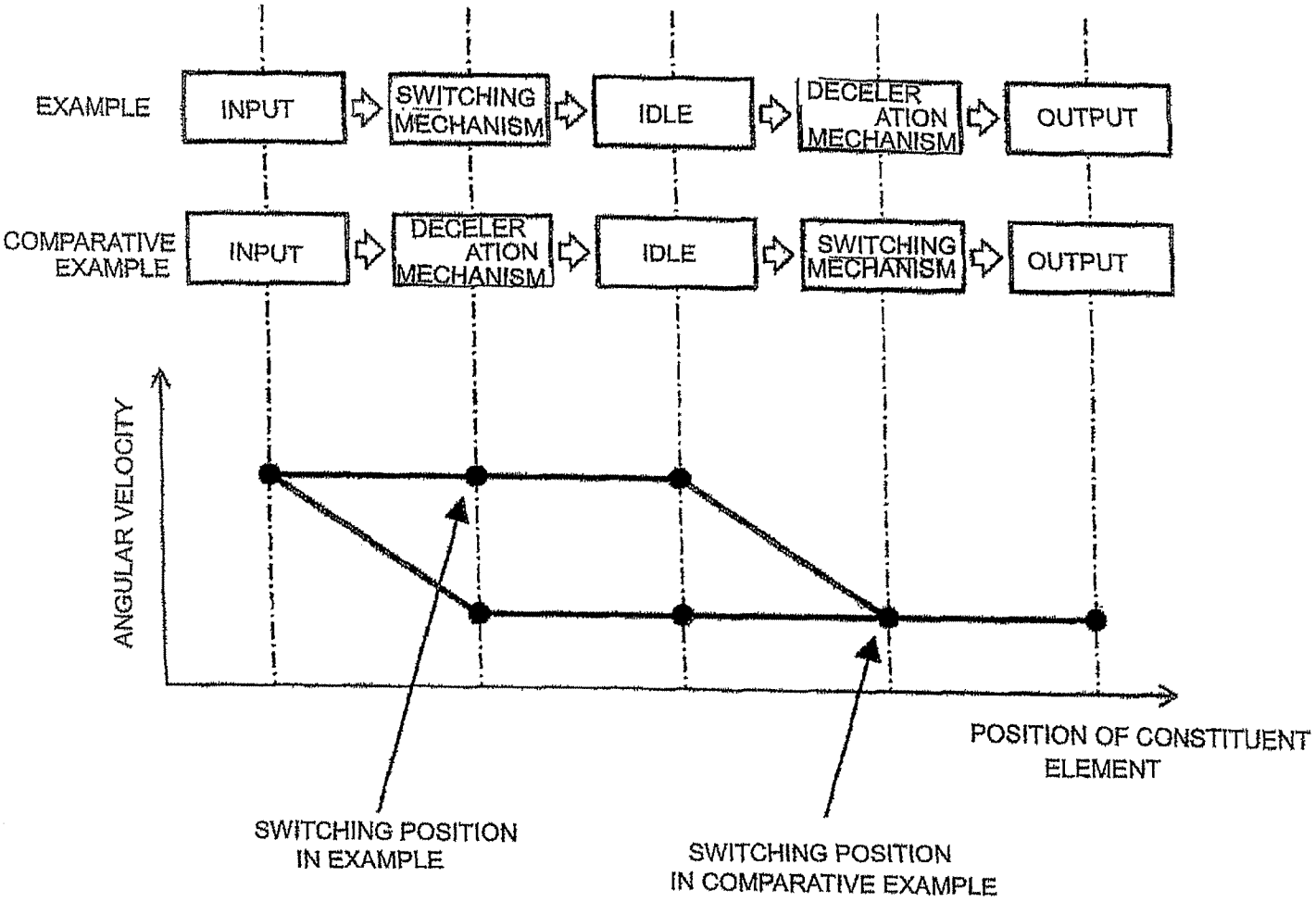
FIG. 14 An illustrative diagram showing an influence exerted by the position of the motive power transmission switching mechanism on a motive power transmission path in the sheet member supply device according to the first embodiment of the present invention.

The operation of the motive power transmission mechanism 60 in the sheet member supply device 40 will then be described with reference to FIGS. 13 and 14. FIG. 13 is a timing chart showing the operation of the motive power transmission mechanism 60. FIG. 14 is an illustrative diagram showing an influence exerted by the position of the motive power transmission switching mechanism 63 on the motive power transmission path.

The time chart shown in FIG. 13 shows, sequentially from above, variations over time in the number of sheet members S stacked within the storage cassette 42, the position (the position of the pickup roller 51) of the sheet member S in the uppermost layer among the sheet members S stacked, the state of the engagement between the nail 68*e* at the tip end of the lever 68*d* and the nail locking cam 68*f* and the turning on and off of the transmission of the motive power to the stacking plate displacement mechanism 44.

In the initial stage (time t0) of the supply of the sheet members S, the sheet member S in the uppermost layer is in contact with the pickup roller 51 in a predetermined upper limit position. Here, the lever 68*d* on the side of the nail 68*e* is pushed up with the lever operation cam portion 68*c* by the action of the position detection mechanism 68 of the sheet member S, and thus the engagement between the nail 68*e* and the nail locking cam 68*f* is cancelled. Since the locking gear 67 and the switching gear 66*h* can be rotated, the motive power input to the input gear 66*b* of the planetary gear mechanism 66 is not output from the output gear 66*f*. In other words, the transmission of the motive power from the drive source 45 to the stacking plate displacement mechanism 44 is turned off.

As the supply of the sheet members S proceeds, the number of sheet members S stacked in the storage cassette 42 is reduced, and the position of the sheet member Sin the uppermost layer is gradually lowered accordingly. In other words, the lever 68*d* on the side of the nail 68*e* is gradually lowered with the lever operation cam portion 68*c* by the action of the position detection mechanism 68 of the sheet member S.

When the sheet member S in the uppermost layer reaches a predetermined lower limit position, the nail 68*e* which is gradually moved downward is engaged with the nail locking cam 68*f*. In this way, the locking gear 67 approaches the support member 61, and thus the regulation of the rotation of the nail locking cam 68*f* and the locking gear 67 is held. Then, since the locking gear 67 and the switching gear 66*h* cannot be rotated, the motive power input to the input gear 66*b* of the planetary gear mechanism 66 is output from the output gear 66*f*. In other words, the transmission of the motive power from the drive source 45 to the stacking plate displacement mechanism 44 is turned on.

When the motive power is transmitted to the stacking plate displacement mechanism 44, the rotation shaft 44*a* and the push-up lever 44*b* are rotated, and thus the downstream side of the sheet member stacking plate 43 in the sheet member supply direction which is pushed up by the push-up lever 44*b* is raised. When the sheet member S in the uppermost layer reaches the predetermined upper limit position, the nail 68*e* of the lever 68*d* is moved upward, and thus the engagement with the nail locking cam 68*f* is cancelled. Then, the motive power input to the input gear 66*b* of the planetary gear mechanism 66 is not output from the output gear 66*f*, and the transmission of the motive power from the drive source 45 to the stacking plate displacement mechanism 44 is turned off.

The upper portion of FIG. 14 shows motive power transmission paths in an example and a comparative example, and the lower portion thereof shows the rotation angular velocities of the locking gear 67 and the nail locking cam 68*f* corresponding to the positions of constituent elements on the motive power transmission paths. Among the constituent elements on the motive power transmission paths, the "switching mechanism" indicates the motive power transmission switching mechanism 63, the "idle" indicates an intermediate mechanism (the motive power transmission regulation portion 64) and the "deceleration mechanism" indicates the paradox planetary gear mechanism 65.

As shown in FIG. 14, in the example, the motive power transmission switching mechanism 63 is closer to the input than the paradox planetary gear mechanism 65, and the rotation angular velocities of the locking gear 67 and the nail locking cam 68*f* are angular velocities before the deceleration. In this way, since the movement distance of the nail locking cam 68*f* in a circumferential direction per unit time is relatively long, it is possible to enhance the accuracy of the switching of the transmission of the motive power.

On the other hand, in the comparative example, the motive power transmission switching mechanism 63 is farther from the input than the paradox planetary gear mechanism 65, and the rotation angular velocities of the locking gear 67 and the nail locking cam 68*f* are angular velocities after the deceleration. In this way, since the movement distance of the nail locking cam 68*f* in the circumferential direction per unit time is relatively short, it is difficult to obtain the preferred accuracy of the switching of the transmission of the motive power.

<Second Embodiment>

Figure 15:
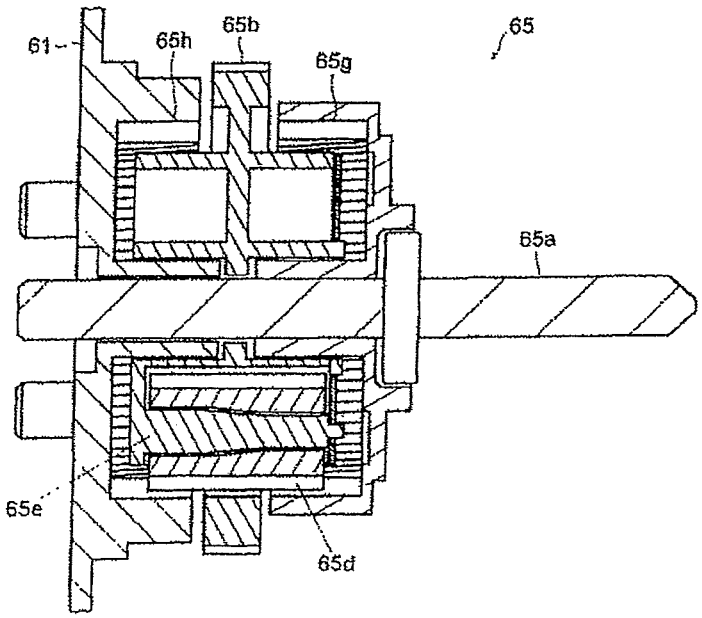
FIG. 15 A horizontal cross-sectional view of the paradox planetary gear mechanism of a motive power transmission mechanism in a sheet member supply device according to a second embodiment of the present invention.

A sheet member supply device according to a second embodiment of the present invention will then be described with reference to FIG. 15. FIG. 15 is a horizontal cross-sectional view of the paradox planetary gear mechanism of a motive power transmission mechanism in the sheet member supply device. Since the basic configuration of this embodiment is the same as that of the first embodiment described previously, the same constituent elements as in the first embodiment are identified with the same symbols, and their description will be omitted.

As shown in FIG. 15, in the sheet member supply device 40 of the second embodiment, the paradox planetary gear mechanism 65 of the motive power transmission mechanism 60 includes a fixed internal gear 65*h*. The fixed internal gear 65*h* is formed integrally in the support member 61 of the motive power transmission mechanism 60.

<Third Embodiment>

Figure 16:
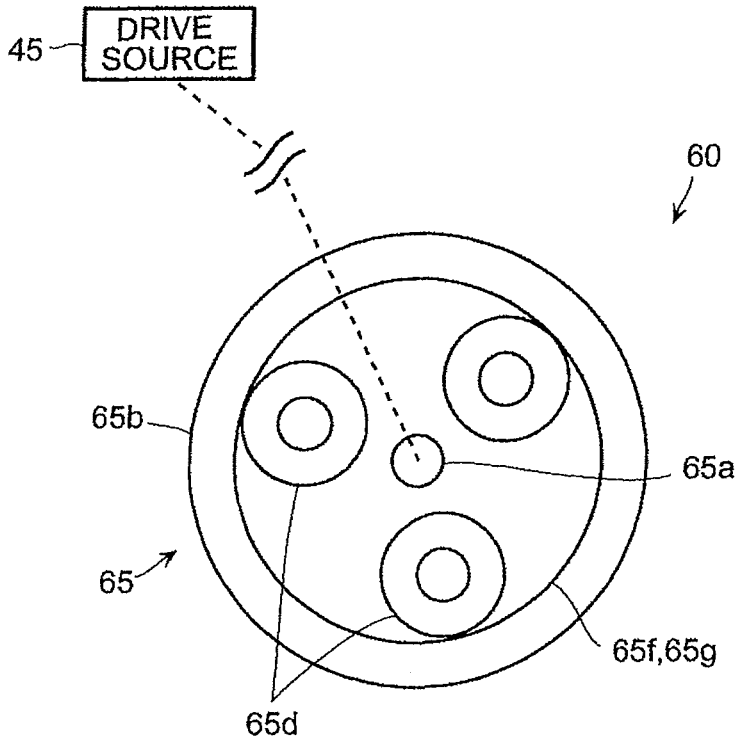
FIG. 16 A schematic back view of the motive power transmission mechanism of a sheet member supply device according to a third embodiment of the present invention.

A sheet member supply device according to a third embodiment of the present invention will then be described with reference to FIG. 16. FIG. 16 is a schematic back view of the motive power transmission mechanism of the sheet member supply device. Since the basic configuration of this embodiment is the same as that of the first embodiment described previously, the same constituent elements as in the first embodiment are identified with the same symbols, and their description be omitted.

As shown in FIG. 16, in the sheet member supply device 40 of the third embodiment, the motive power transmission mechanism 60 includes the paradox planetary gear mechanism 65. This motive power transmission mechanism 60 does not include the motive power transmission switching mechanism 63 and the motive power transmission regulation portion 64 described in the first embodiment.

As the position detection mechanism of the sheet member S, for example, a lower limit sensor 56 of the pickup roller 51 is utilized (see FIG. 5). The lower limit sensor 56 is formed with, for example, a transmission type optical sensor, and detects that its optical path is blocked by the lowering of a predetermined part of the coupling member 55 in the supply portion 50.

As the supply of the sheet members S proceeds, the number of sheet members S stacked in the storage cassette 42 is reduced, and the position of the sheet member Sin the uppermost layer is gradually lowered accordingly. Then, the lower limit sensor 56 detects by the layering of the coupling member 55 that the position of the pickup roller 51 is lowered. to a predetermined lower limit position. In this way, a control signal for turning on the drive of the drive source 45 is transmitted, and the motive power of the drive source 45 is transmitted through the paradox planetary gear mechanism 65 to the stacking plate displacement mechanism 44. The drive of the drive source 45 is kept on only in a period until the sheet member S in the uppermost layer reaches a predetermined upper limit position.

As in the first, second and third embodiments, the sheet member supply device 40 of the image forming apparatus 1 includes the sheet member stacking plate 43 in which the sheet members S are stacked on its upper surface, the pickup roller 51 which makes contact with, from above, the uppermost layer of the sheet members S stacked on the sheet member stacking plate 43, the stacking plate displacement mechanism 44 which displaces the sheet member stacking plate 43 upward, the motive power transmission mechanism 60 which transmits the motive power obtained from the drive source 45 to the stacking plate displacement mechanism 44 and the paradox planetary gear mechanism 65 which is provided in the motive power transmission mechanism 60.

In this configuration, it is possible to make the self-lock function (self-holding function) act while the deceleration function is made to act with a simple configuration of the paradox planetary gear mechanism 65. In this way, the paradox planetary gear mechanism 65 is prevented from being reversely rotated by a load from the side of the stacking plate displacement mechanism 44. In other words, with a simple configuration, it is possible to reduce the unintentional downward displacement of the sheet member stacking plate 43.

In the sheet member supply device 40 of the first and second embodiments, the motive power transmission switching mechanism 63 for turning on and off the transmission of the motive power from the drive source 45 to the paradox planetary gear mechanism 65 is provided.

In this configuration, the motive power transmission switching mechanism 63 is closer to the input than the paradox planetary gear mechanism 65, and the rotation angular velocities of the locking gear 67 and the nail locking cam 68*f* are the angular velocities before the deceleration. In this way, since the movement distance of the nail locking cam 68*f* in the circumferential direction per unit time is relatively long, it is possible to enhance the accuracy of the switching of the transmission of the motive power.

The stacking plate displacement mechanism 44 includes the rotation shaft 44*a* for moving the sheet member stacking plate 43 upward, and the shaft line of the rotation shaft 65*a* of the paradox planetary gear mechanism 65 coincides with the shaft line of the rotation shaft 44*a* of the stacking plate displacement mechanism 44.

In this configuration, it is possible to more enhance the accuracy of the switching of the transmission of the motive power.

The sheet member supply device 40 of the first embodiment includes the support member 61 which supports the rotation shaft 65*a* of the paradox planetary gear mechanism 65, and the fixed internal gear 65*f* of the paradox planetary gear mechanism 65 is fixed to the support member 61. In the sheet member supply device 40 of the second embodiment, the fixed internal gear 65*h* of the paradox planetary gear mechanism 65 is formed integrally in the support member 61.

In these configurations, it is possible to acquire, with a simple configuration, rigidity for a load related to the rotation shaft 44*a* of the stacking plate displacement mechanism 44 and an impact related to the engagement with the rotation shaft 65*a* of the paradox planetary gear mechanism 65.

In the sheet member supply device 40 of the first and second embodiments, the motive power transmission switching mechanism 63 includes the planetary gear mechanism 66.

In this configuration, it is possible to form the motive power transmission mechanism 60 with a simpler configuration.

In the sheet member supply device 40 of the first and second embodiments, between the motive power transmission switching mechanism 63 and the paradox planetary gear mechanism 65, the motive power transmission regulation portion 64 for transmitting the motive power only in one direction is provided.

In this configuration, when the motive power transmission switching mechanism 63 turns off the transmission of the motive power from the drive source 45 to the paradox planetary gear mechanism 65, it is possible to prevent the output gear 64*c* of the motive power transmission regulation portion 64 from being unintentionally rotated by the action of the regulation member 64*d* of the motive power transmission regulation portion 64. In this way, it is possible to reliably realize the blocking of the transmission of the motive power to the paradox planetary gear mechanism 65.

The sheet member supply device 40 of the first and second embodiments includes the position detection mechanism 68 of the sheet member S for turning on the transmission of the motive power by the motive power transmission switching mechanism 63 when a predetermined number of sheet members S stacked on the sheet member stacking plate 43 are supplied.

In this configuration, it is possible to control the turning on and off of the transmission of the motive power to the stacking plate displacement mechanism 44 according to the number of sheet members S supplied. In this way, it is possible to suitably maintain the performance of the supply of the sheet members S while reducing the unintentional downward displacement of the sheet member stacking plate 43.

Furthermore, the sheet member supply device 40 configured as described above and the drive source 5 which applies the motive power to the motive power transmission mechanism 60 are incorporated in the image forming apparatus 1. Furthermore, the drive source 5 also applies the motive power to the pickup roller 51.

In these configurations, it is possible to reduce the motive power source in the image forming apparatus 1. Hence, with a simple configuration in which the number of components and the number of production steps are reduced, it is possible to provide the image forming apparatus 1 that can reduce the unintentional downward displacement of the sheet member stacking plate 43.

Although the embodiments of the present invention are described above, the scope of the present invention is not limited to them, and various modifications are possible without departing from the spirit of the invention.

For example, although in the embodiments described above, the image forming apparatus 1 including the sheet member supply device 40 is a so-called tandem-type color printing image forming apparatus that forms an image by sequentially superimposing, with intermediate transfer belt 11, images of a plurality of colors, there is no limitation to this type of apparatus, and a color printing image forming apparatus or a monochrome printing image forming apparatus other than the tandem type may be used.

What is claimed is:

1. A sheet member supply device comprising:

a sheet member stacking plate in which sheet members are stacked on an upper surface;

a pickup roller which makes contact with, from above, an uppermost layer of the sheet members stacked on the sheet member stacking plate;

a stacking plate displacement mechanism which displaces the sheet member stacking plate upward;

a motive power transmission mechanism which transmits motive power obtained from a drive source to the stacking plate displacement mechanism; and a paradox planetary gear mechanism which is provided in the motive power transmission mechanism, the paradox planetary gear mechanism including a fixed internal gear and a movable internal gear.

2. The sheet member supply device according to claim 1, wherein a motive power transmission switching mechanism which turns on and off the transmission of the motive power from the drive source to the paradox planetary gear mechanism is provided.

3. The sheet member supply device according to claim 2, wherein the stacking plate displacement mechanism includes a rotation shaft for moving the sheet member stacking plate upward, and a shaft line of a rotation shaft of the paradox planetary gear mechanism coincides with a shaft line of the rotation shaft included in the stacking plate displacement mechanism.

4. The sheet member supply device according to claim 1 further comprising:

a support member which supports a rotation shaft of the paradox planetary gear mechanism, wherein the fixed internal gear of the paradox planetary gear mechanism is fixed to the support member.

5. The sheet member supply device according to claim 4, wherein the fixed internal gear of the paradox planetary gear mechanism is formed integrally in the support member.

6. The sheet member supply device according to claim 4, wherein the motive power transmission switching mechanism includes a planetary gear mechanism.

7. The sheet member supply device according to claim 4, wherein between the motive power transmission switching mechanism and the paradox planetary gear mechanism, a motive power transmission regulation portion for transmitting the motive power only in one direction is provided.

8. The sheet member supply device according to claim 4, wherein the motive power transmission switching mechanism includes a sheet member position detection mechanism for turning on the transmission of the motive power when a predetermined number of the sheet members stacked on the sheet member stacking plate are supplied.

9. An image forming apparatus comprising:

the sheet member supply device according to claim 1; and the drive source which applies the motive power to the motive power transmission mechanism.

10. The image forming apparatus according to claim 9, wherein the drive source applies the motive power to the pickup roller.

11. The sheet member supply device according to claim 1, wherein the paradox planetary gear mechanism includes an input gear and a planetary gear which revolves around the input gear, and the planetary gear couples to the fixed internal gear and the movable internal gear.

* * * * *